US006995362B1

(12) United States Patent
Burke et al.

(10) Patent No.: US 6,995,362 B1
(45) Date of Patent: Feb. 7, 2006

(54) DUAL ELECTROSPRAY IONIZATION SOURCE FOR MASS SPECTROMETER

(75) Inventors: Michael J. Burke, Rochester, MN (US); Patrick E. Caskey, Rochester, MN (US); David C. Muddiman, Rochester, MN (US)

(73) Assignee: Mayo Foundation for Medical Education and Research, Rochester, MN (US)

( * ) Notice: Subject to any disclaimer, the term of this patent is extended or adjusted under 35 U.S.C. 154(b) by 0 days.

(21) Appl. No.: 10/772,229

(22) Filed: Feb. 4, 2004

Related U.S. Application Data

(60) Provisional application No. 60/444,888, filed on Feb. 4, 2003.

(51) Int. Cl.
*H01J 49/26* (2006.01)

(52) U.S. Cl. ..... 250/288; 250/285

(58) Field of Classification Search ..... 250/288, 250/285, 423 R
See application file for complete search history.

(56) References Cited

U.S. PATENT DOCUMENTS 5,668,370 A * 9/1997 Yano et al. ..... 250/288
6,066,848 A 5/2000 Kassel et al.
6,191,418 B1 2/2001 Hindsgaul et al.
6,350,617 B1 2/2002 Hindsgaul et al.
6,410,915 B1 6/2002 Bateman et al.
6,454,193 B1 * 9/2002 Busick et al. ..... 239/690
6,657,191 B2 * 12/2003 Park ..... 250/288
2001/0042828 A1 11/2001 Hindsgaul et al.
2002/0043624 A1 4/2002 Hindsgaul et al.

OTHER PUBLICATIONS

Mann et al., *Analysis of Proteins and Proteomes By Mass Spectrometry*, Annu. Rev. Biochem. 2001, 70:437–73.
Flora and Muddman, *High Mass Accuracy of Product Ions Produced by SORI–CID Using a Dual Electrospray Ionization Source Coupled with FTICR Mass Spectrometry*, Analytical Chemistry, 2001, 73, 6, 1247–1251.
Hannis and Muddiman, *A Dual Electrospray Ionization Source Combined With Hexapole Accumulation to Achieve High Mass Accuracy of Biopolymers in Fourier Transform Ion Cyclotron Resonance Mass Spectroscopy*, J. Am. Soc. Mass. Spectrom. 2000, 11, 876–883.

* cited by examiner

*Primary Examiner*—Kiet T Nguyen
(74) *Attorney, Agent, or Firm*—Faegre & Benson LLP

(57) ABSTRACT

A dual electrospray ionization source for use in connection with a mass spectrometer having an inlet port. The source includes a polymer nozzle holder having a drive axis and a pair of continuously spraying nozzles mounted to the nozzle holder at spaced-apart positions. An adjustment mechanism allows positional adjustment of one nozzle with respect to the other nozzle on the nozzle holder. A programmable motor is connected to the nozzle holder at the drive axis. The motor rotationally and reciprocally drives the nozzle holder to sequentially position each of the nozzles in alignment with an inlet port of mass spectrometer.

17 Claims, 7 Drawing Sheets

DUAL ELECTROSPRAY IONIZATION SOURCE FOR MASS SPECTROMETER

REFERENCE TO RELATED APPLICATION

This application claims the benefit of U.S. Provisional Application Ser. No. 60/444,888, filed on Feb. 4, 2003 and entitled Electrospray Ionization (ESI) Source for Mass Spectrometer, which is incorporated herein by reference in its entirety.

FIELD OF THE INVENTION

The present invention relates generally to sample sources for mass spectrometers. In particular, the invention is an electrospray ionization source.

BACKGROUND OF THE INVENTION

The influence of mass spectrometry has emerged greatly due to its applications in genomics, proteomics and metabonomics. Matrix-assisted laser desorption ionization (MALDI) and electrospray ionization (ESI) allows for the production of intact gas-phase ions of large non-volatile biomolecules. Several biological problems concerning the use of ESI-MS demand high-mass accuracy. These mass spectrometry techniques are disclosed generally in Mann et al., *Analysis of Proteins and Proteomes By Mass Spectrometry,* Annu. Rev. Biochem. 2001, 70:437–73, and Flora and Muddiman, *High Mass Accuracy of Product Ions Produced by SORI-CID Using a Dual Electrospray Ionization Source Coupled with FTICR Mass Spectrometry,* Analytical Chemistry, 2001, 73, 6, 1247–1251, both of which are incorporated herein by reference.

The measurement of a peptide's mass to within 1–2 ppm has been shown to uniquely identify the peptide and its source protein when the C-terminal amino acid is constrained to an arginine or lysine. Fourier transform ion cyclotron resonance mass spectrometry (FT-ICR-MS) has the ability to offer $\leqq 1$ ppm mass accuracy and has proven to be useful for protein identification in conjunction with protein databases. However, space-charge effects are known to profoundly influence the level of mass accuracy that can be achieved by FT-ICR-MS.

Accurate mass measurements using FT-ICR-MS depend on the ability to accurately measure an ion's cyclotron frequency while it is trapped in the homogeneous region of the magnetic field. Variations in magnetic field strength, trapping potentials, ion populations and excitation variables can produce changes in the cyclotron frequency that must be correctly compensated if accurate mass measurements are to be obtained. Efforts to account for these variables and increase the mass accuracy for FT-ICR-MS can essentially be divided into two general strategies: 1) external and 2) internal mass calibration.

External calibration, which relies on a calibration equation and a matching of total ion intensities for peaks of the analyte and the calibration spectra, has recently been shown to yield mass accuracies in the low ppm range. Another approach capitalized on the multiplicity of charge-states and minimized the mass error by systematically varying the frequency offset. Unfortunately, external calibration methods to account for total ion intensity can become tedious when a variety of ionic species results in a multiplicity of ion cloud distributions. Moreover, the use of a calibration equation based solely on the total ion intensity may be an over simplification. Regardless of these intricate arguments, it is generally well accepted that compensation for total ion intensity (i.e., variations in the electric field which perturb the frequency of the trapped ions in a linear fashion) is the dominant factor which must be taken into account to achieve high mass accuracy.

Internal calibration, also relying on a calibration equation, is based on measuring ion masses for the analyte and internal standard under identical conditions. Internal calibration is certainly a more straightforward approach because space charge effects, trapping, and detection factors are essentially identical for all species. The use of a dual electrospray ionization source to internally mass calibrate FT-ICR mass spectra of biological molecules, including calibrating tandem mass spectra, is disclosed generally in the Flora and Muddiman *Analytical Chemistry* article identified above and in Hannis and Muddiman, *A Dual Electrospray Ionization Source Combined With Hexapole Accumulation to Achieve High Mass Accuracy of Biopolymers in Fourier Transform Ion Cyclotron Resonance Mass Spectroscopy,* J. Am. Soc. Mass. Spectrom. 2000, 11 , 876–883, which is hereby incorporated by reference. This reported source was used for a wide variety of investigations. Separation of the internal calibrant from the analyte avoids preferential ionization and lends itself to coupling with on-line liquid separations. There are other reports, which utilized this general strategy with dual-ESI with FT-ICR and alternative mass analyzer technology to obtain high mass measurement accuracy each with its own advantages and disadvantages.

There remains, however, a continuing need for improved ESI sources. In particular, there is a need for ESI sources that are capable of accurately positioning the sample streams within time frames that are compatible with liquid separations. Any such source should also be capable of operating properly for extended periods of time.

SUMMARY OF THE INVENTION

The present invention is a relatively fast and accurate electrospray ionization source capable of operating for extended periods of time in connection with a mass spectrometer having an inlet port. One embodiment of the invention includes a nozzle holder and a plurality of nozzles mounted to the holder at spaced-apart locations. An actuator drives the nozzle holder to sequentially position each of the nozzles in fluid transfer communication with an inlet port of a mass spectrometer while the plurality of nozzles are continuously spraying.

In preferred embodiments the motor reciprocally and rotationally drives the nozzle holder to sequentially position the nozzles at frequencies up to or greater than 4 Hz. The source can include an actuator controller for controllably decelerating the nozzle holder when positioning the nozzles. The nozzle holder is preferably free from a shutter between the nozzles and mass spectrometer inlet port.

DETAILED DESCRIPTION OF THE PREFERRED EMBODIMENTS

Figure 1:
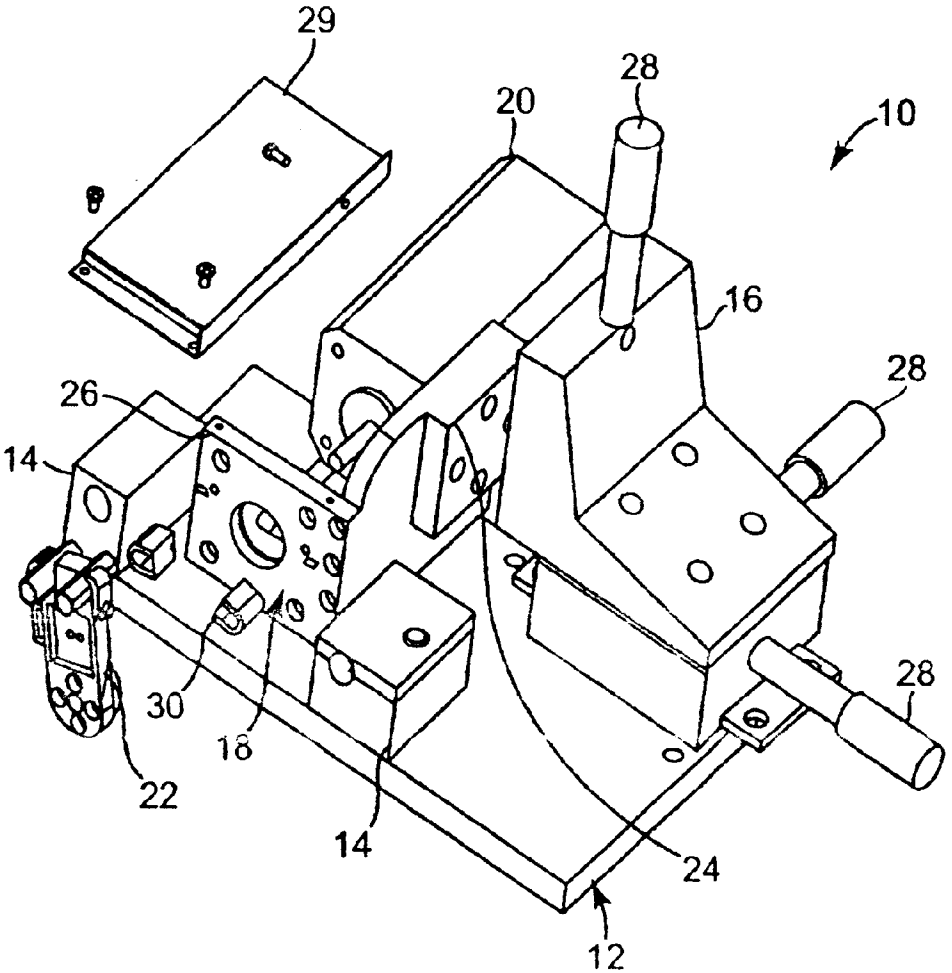
FIG. 1 is an exploded view of an ESI source in accordance with one embodiment of the present invention.

A dual ESI source 10 in accordance with one embodiment of the invention is illustrated generally in FIG. 1. As shown, the source 10 includes a base plate 12, a pair of trunnions 14 (one of which includes a clamp), an X-Y-Z stage 16, a motor mount 18, motor 20 and nozzle holder 22. The trunnions 14 are mounted to the base plate 12 and have apertures for receiving mounting rods that extend from a mass spectrometer (not shown in FIG. 1). The X-Y-Z stage 16 is also mounted to base plate 12. Motor mount 18 is an L-shaped member in the embodiment shown and includes a side bracket 24 mounted to the X-Y-Z stage 16, and a face plate 26 to which the motor 20 is mounted. Nozzle holder 22 is mounted to the shaft of motor 20. Through actuation of the micrometers 28, the X-Y-Z stage can be used to adjust the position of the motor and nozzle holder. Also shown in FIG. 1 is a heat shield 29 that can be mounted over motor 20. Mechanical stops 30 are mounted to the face plate 26 to minimize potentially damaging over-rotation of the nozzle holder 22. In one embodiment of the invention, the motor 20 is a SilverMax 17 available from QuickSilver Controls, Inc. This particular motor 20 includes an integrated position encoder (not visible in FIG. 1). A forty-eight volt power supply (not shown) can be used to power motor 20.

Figure 2:
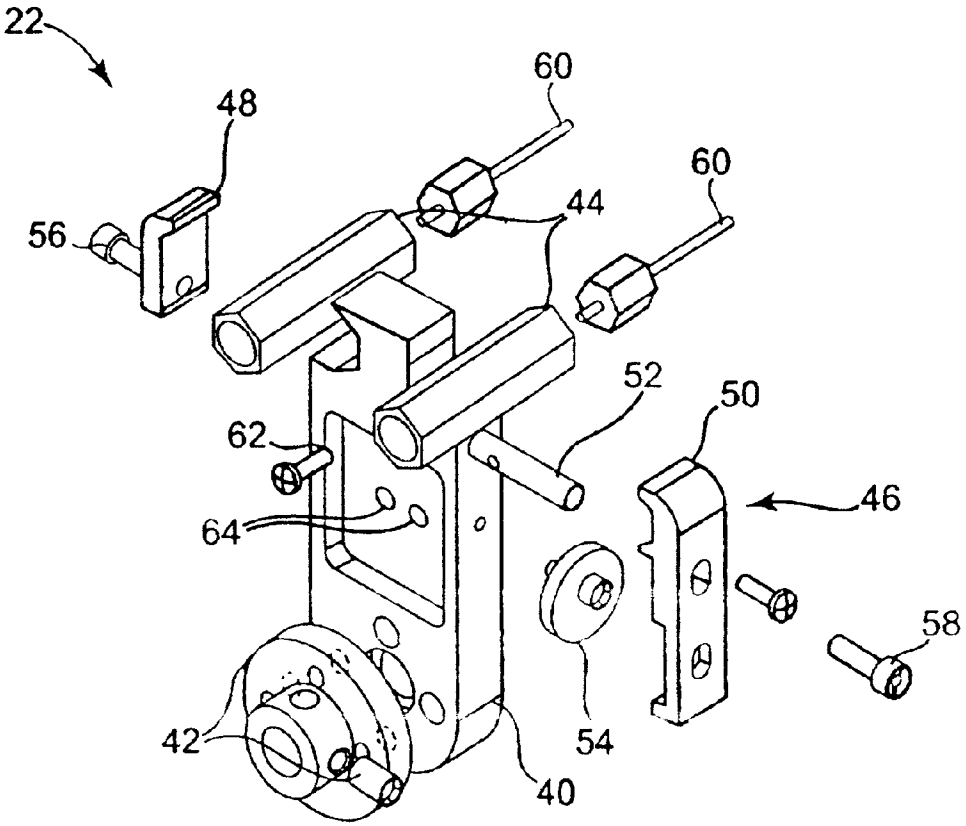
FIG. 2 is a detailed exploded view of the nozzle holder shown in FIG. 1.
Figure 3:
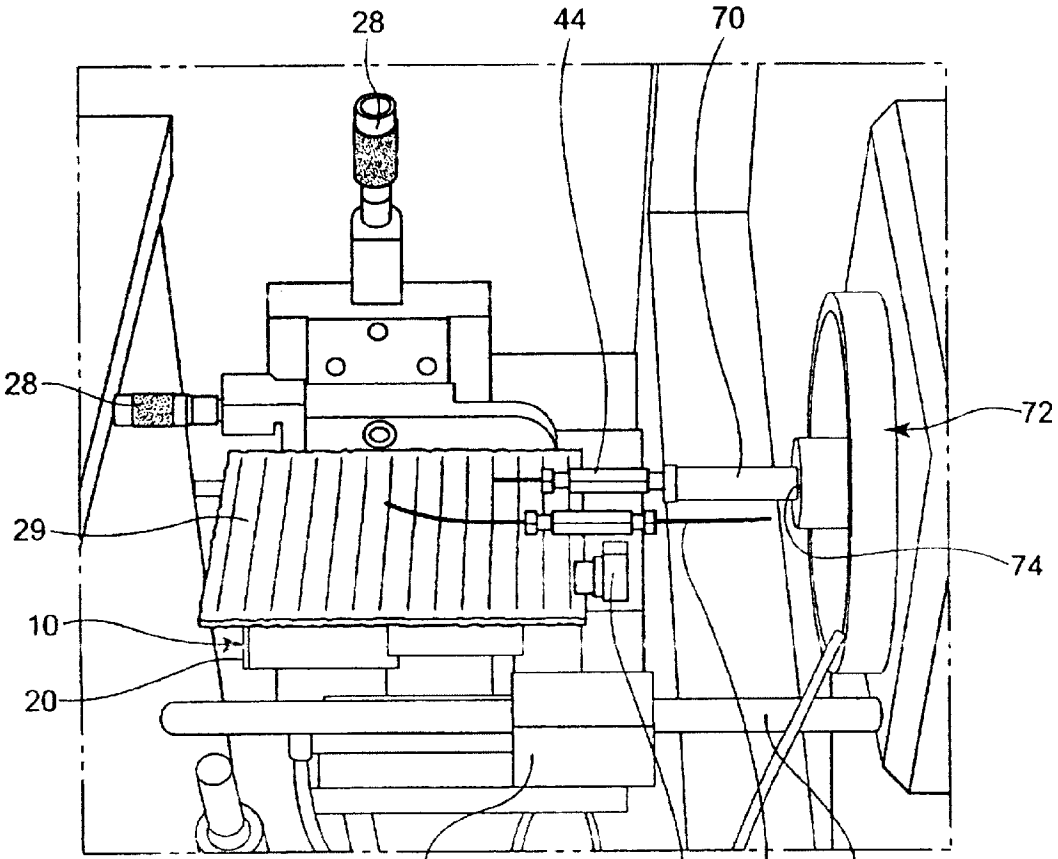
FIGS. 3–6 are illustrations of the ESI source shown in FIG. 1 mounted to a mass spectrometer.
Figure 4:
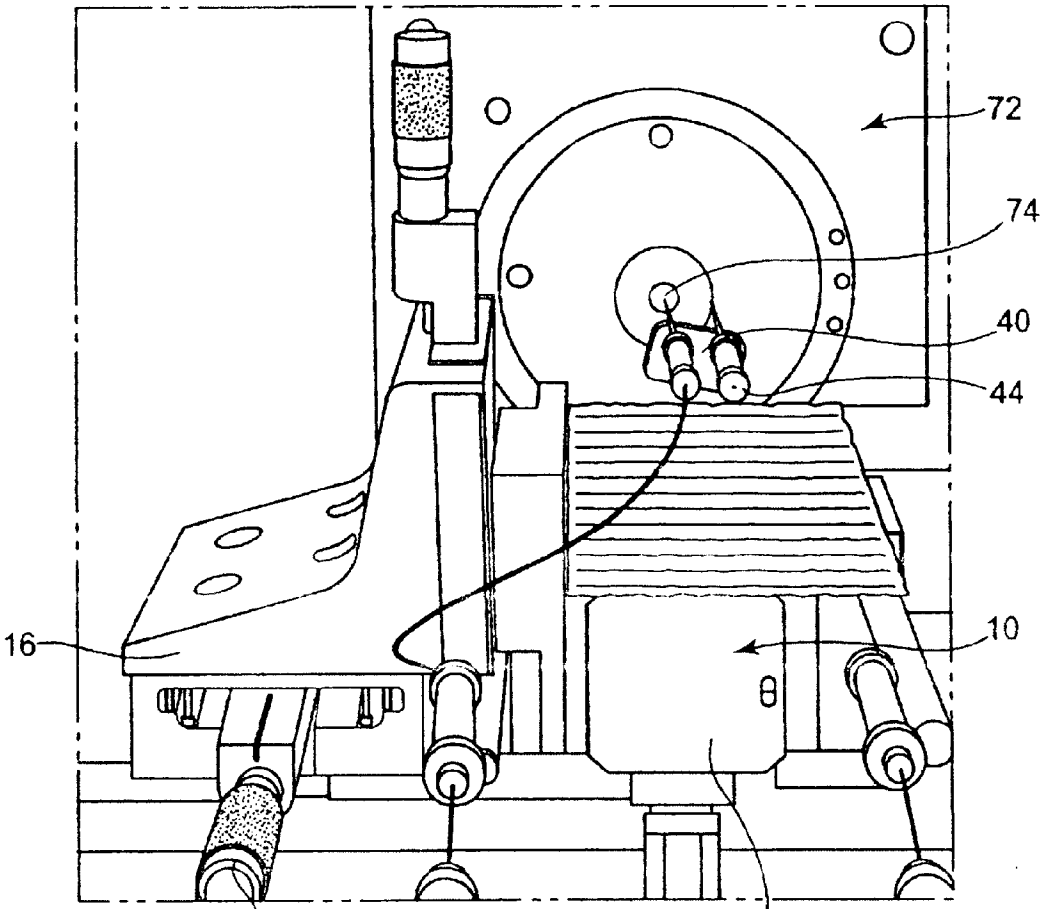
Figure 5:
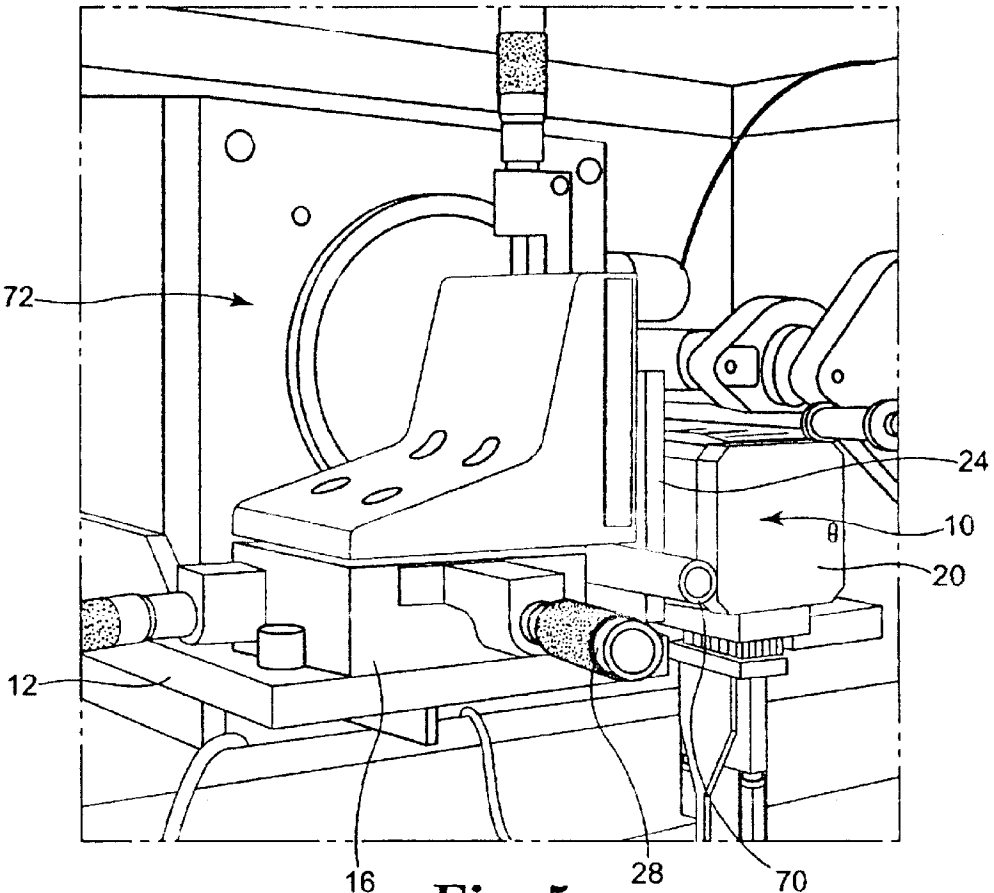
Figure 6:
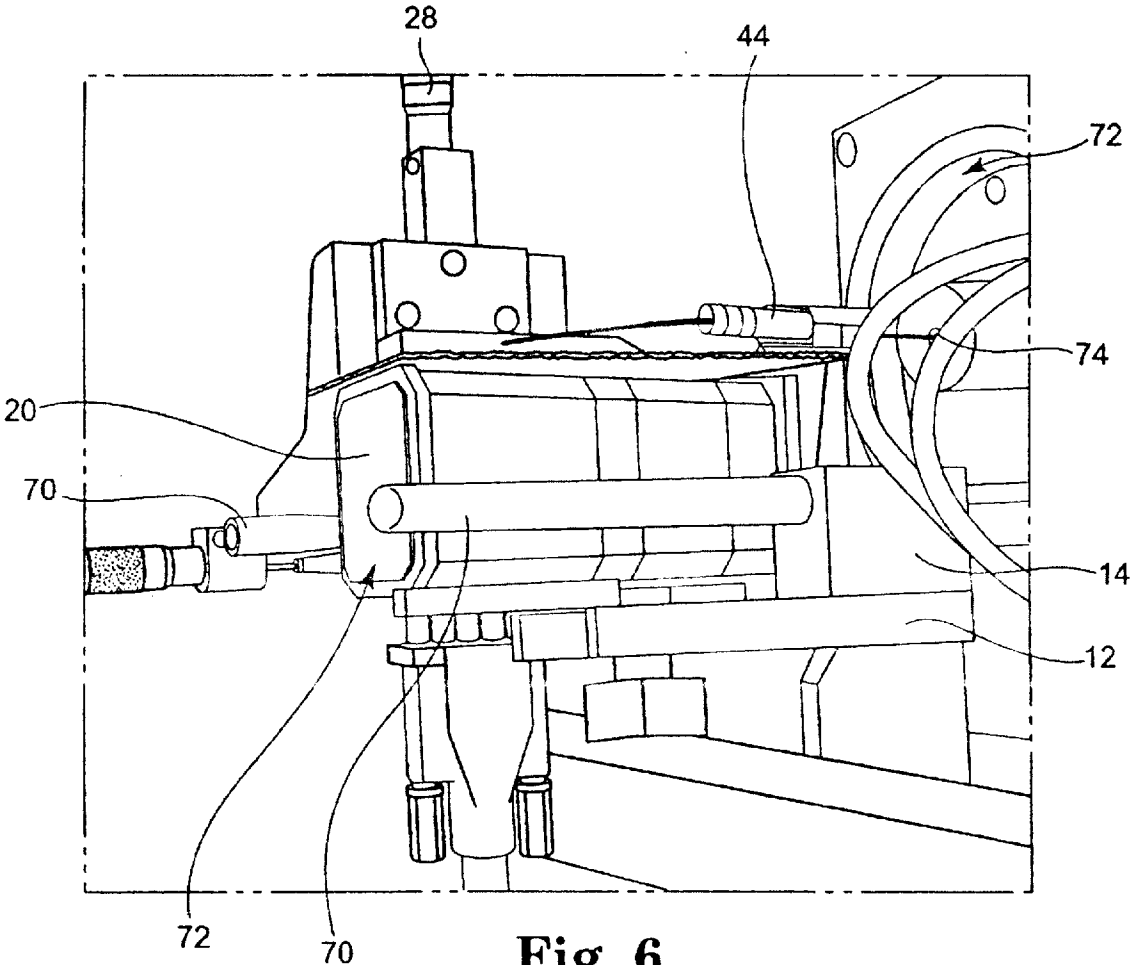

Nozzle holder 22 can be described in greater detail with reference to FIG. 2. As shown, nozzle holder 22 includes a holder body 40, motor mount hub 42, unions 44, and adjustable clamp assembly 46. The clamp assembly includes a fixed clamp 48, adjustable clamp 50, electrical connector 52 and eccentric cam 54. Holder body 40, which is formed from an electrically insulating polymer such as Delrin in one embodiment, is shaped at one end to receive the unions 44. The unions 44 are hexagonal, metal members available from Valco in one embodiment, although other unions can also be used. Connector 52 is an electrically conductive member and extends through the holder body 40. Fixed clamp 48 is fastened to connector 52 on one side of the holder body 40 (e.g., by screw 56) to secure a first union 44 to the holder body. Adjustable clamp 50 is fastened to connector 52 on the opposite side of the holder body 40 (e.g., by screw 58) to secure the second union 44 to the holder body at a position spaced apart from the first union 44. Unions 44 are preferably positioned at the same radial distance from the rotational axis of the holder body 40. The radial position of the second union 44 can be finely adjusted and fixed with respect the first union 44 by the orientation of cam 54 on the adjustable clamp 50. The holder body 40 is mounted to the shaft of motor 20 by hub 42. Although the unions 44 are electrically connected by the connector 52 in the illustrated embodiment, other electrical structures can be used to provide this function. Similarly, other structures can be used to mount the unions 44 to the holder body 40.

Conventional electrospray emitters or nozzles are mounted to the unions 44 and connected to feed lines 60. The unions 44 connect the lines from the pumping equipment (not shown) to the nozzles. The sample lines 60 extend over the heat shield and connect to the unions near the face plate 26. The electrospray bias voltage source is connected through the face of the nozzle holder body 40 to the connector 52 by a screw 62 in the embodiment shown. A pair of holes 64 through the holder body 40 provide strain relief connection points for the bias voltage connection wire.

FIGS. 3–6 illustrate the ESI source 10 mounted to a pair of mounting rods 70 extending from a mass spectrometer 72. During a setup procedure the source 10 is adjusted to align each of the nozzles 60 with an inlet port 74 of the mass spectrometer 72. Following an initial positioning, the position of the first nozzle 60 (i.e., the nozzle in the union 44 mounted to the holder body 40 by fixed clamp 48) is positioned using the micrometers 28 of X-Y-Z stage 16. The second nozzle 60 is positioned using 2 mechanisms. The first is by programming the motor (through the use of a potentiometer) to set the angular position of the nozzle. The second is through use of the adjustable clamp assembly 46. In particular, the position of cam 54 cam be moved to adjust the radial position of the union 44 to which the second nozzle 60 is mounted.

Figure 7:
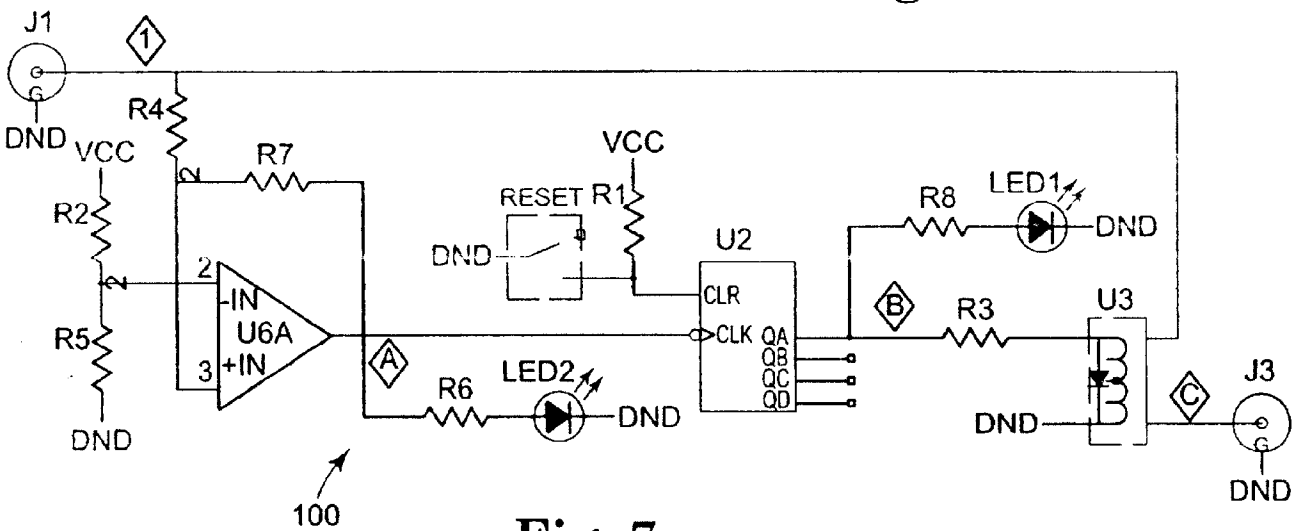
FIG. 7 is an illustration of a circuit that can be functionally connected between the mass spectrometer shown in FIGS. 3–6 and a laser or other ion dissociation methodology of a mass spectrometer (not shown).

FIG. 7 is an illustration of a circuit 100 that can be functionally connected between the mass spectrometer 72 and the laser controller of the mass spectrometer (not shown). A pulse originating from the mass-spectrometer 72 is input on BNC connector J1 (timing signal I in FIG. 8) and converted to a TTL clock pulse by op amp U6 (timing signal A). Presence of this clock pulse is indicated by LED2. Counter U2 receives the clock pulses, where they are divided by 2 to produce a control pulse (timing signal B) with half the frequency of the input pulse. This control pulse activates the relay U3 and is indicated by LED1. The relay gates the original pulse through to the output J3 (timing signal C). A reset function to assure a known state is provided by momentary switch SW1 and is pressed at the start of each pulse train transmission. The output pulse at BNC connector J3 is connected to the laser controller and occurs at half the frequency of the programmed pulse from the mass-spectrometer, with the original amplitude and pulse timing intact.

Figure 8:
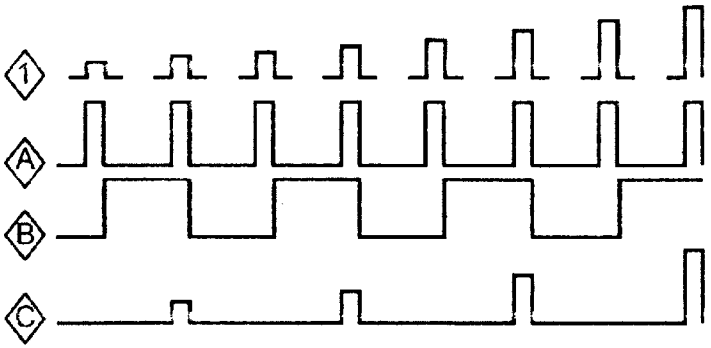
FIG. 8 is an illustration of the pulse timing waveforms present at identified locations of the circuit shown in FIG. 7.

ESI source 10 can be used in conjunction with the gated pulse circuit 100 to extend the functionality of the dual ESI source. The circuit 100 removes the first activation pulse and every other pulse thereafter. Through the use of this circuit 100, switching of each nozzle 60 from one acquisition to another for consecutive acquisitions is enabled. In one embodiment, the first pulse from the gating circuit 100 could sample both the analyte and internal standard affording high mass measurement accuracy while the second pulse from the gating circuit would sample only analyte which could either be detected intact or be dissociated by a variety of methods activated by a pulse derived from the gating circuit. In another embodiment, the first pulse from the gating circuit would sample one flow-stream while the second pulse would sample a different flow stream. In this embodiment, all odd acquisitions represent the first flow stream and even acquisition represent the second flow stream. Voltages could be manipulated on either or both emitters from positive to negative to further extend the utility of the ESI source in conjunction with the gating circuit. FIG. 8 is an illustration of the pulse timing waveform present at identified locations on the circuit 100.

In operation, the nozzles spray continuously as the motor 20 reciprocally drives the nozzle holder 22 to sequentially and rotationally position the nozzles in fluid transfer communication with (e.g., aligned with) the inlet port 74 of the mass spectrometer 72. The relatively low mass of the nozzle holder 22 allows the holder to be driven at relatively high accelerations with relatively low power during the data collection process. The impact of heat from the motor 20 on the samples in the nozzles (and the lines connecting them to the sources) can thereby be reduced. Through the use of a programmable motor and encoder, a programmed motion profile that includes a deceleration phase can be used to drive the motor 20. The amount of mass moving at high velocity near the end of the reciprocal strokes, and therefore vibration of the nozzle holder 22 as it stops moving, can be reduced. The positions of the nozzles over time thereby remain in fluid transfer alignment with the mass spectrometer port. Prototypes of the invention have been operated for sustained switching between nozzles at speeds up to 5 Hz. Using these prototypes in connection with a mass spectrometer, stable ion currents over 45 minute time periods with resulting mass accuracies of 0.88 ppm±0.12 ppm. The switching time between nozzles, which can, but need not be an analyte emitter and an internal standard emitter, can be less than 200 msec, thereby allowing accumulation of both analyte and internal standard in a reservoir prior to injection into a mass spectrometer.

The preferred embodiment of the invention described above does not make use of a separation chamber to separate the spray of one nozzle from that of other nozzles. There is only one inlet port on the mass spectrometer for the plural nozzles. Nor are the nozzles or emitters coaxial or dual-lumen devices in this embodiment. In other embodiments of the invention the dwell time of the nozzles can be set by the mass spectrometer control software (e.g., down to about 50 msec). As noted above, the nozzles of the preferred embodiment spray all the time (i.e., continuously). Stabilization time between sprayers is therefore not required, nor is nozzle valving required. A single voltage is applied to all the nozzles in the preferred embodiment, although different voltages and/or polarities can also be applied. No sealing of the spray environment has been found to be necessary in this embodiment. Since the nozzles move, shutters are not required. Inter-nozzle contamination and cross talk has not been observed. The positions of the sprays can be optimized by either electronic or mechanical approaches.

Although the invention has been described with reference to preferred embodiments, those skilled in the art will recognize that changes can be made in form and detail without departing from the spirit and scope of the invention.

What is claimed is:

1. An electrospray ionization source for use in connection with a mass spectrometer having an inlet port, including:

a nozzle holder;

a plurality of nozzles mounted to the holder at spaced-apart locations;

an actuator for driving the nozzle holder to sequentially position each of the nozzles in fluid transfer communication with an inlet port of a mass spectrometer while the plurality of nozzles are continuously spraying.

2. The electrospray ionization source of claim 1 wherein the actuator reciprocally drives the nozzle holder to sequentially position each of the nozzles in fluid transfer communication with an inlet port of a mass spectrometer.

3. The electrospray ionization source of claim 2 wherein the actuator reciprocally and rotationally drives the nozzle holder.

4. The electrospray ionization source of claim 3 and further including an actuator controller for controllably decelerating the nozzle holder when positioning the nozzles.

5. The electrospray ionization source of claim 4 wherein the actuator sequentially positions each of the nozzles at frequencies greater than 2 Hz.

6. The electrospray ionization source of claim 4 wherein the actuator sequentially positions each of the nozzles at frequencies greater than 4 Hz.

7. The electrospray ionization source of claim 4 wherein the actuator positions the nozzles in communication with an inlet port of a mass spectrometer for dwell times of at least 10 msec.

8. The electrospray ionization source of claim 1 and further including an adjustment mechanism for allowing positional adjustment of at least a first nozzle with respect to a second nozzle on the nozzle holder.

9. The electrospray ionization source of claim 1 wherein the actuator is a programmable motor.

10. The electrospray ionization source of claim 1 wherein the source is free of a shutter between the nozzles and an inlet port of a mass spectrometer.

11. The electrospray ionization source of claim 1 wherein the source has two nozzles mounted to the nozzle holder.

12. The electrospray ionization source of claim 1 wherein the nozzle holder is a polymer member.

13. A dual electrospray ionization source for use in connection with a mass spectrometer having an inlet port, including:

a polymer nozzle holder having a drive axis;

a pair of continuously spraying nozzles mounted to the nozzle holder at spaced-apart positions;

an adjustment mechanism for allowing positional adjustment of one nozzle with respect to the other nozzle on the nozzle holder; and a programmable motor having a shaft connected to the nozzle holder at the drive axis, for rotationally and reciprocally driving the nozzle holder to sequentially position each of the nozzles in alignment with an inlet port of mass spectrometer.

14. The electrospray ionization source of claim 13 wherein the programmable motor drives the nozzle holder at frequencies greater than 2 Hz.

15. The electrospray ionization source of claim 14 and further including an actuator controller for controllably decelerating the nozzle holder when positioning the nozzles.

16. The electrospray ionization source of claim 15 wherein the source is free of a shutter between the nozzles and an inlet port of a mass spectrometer.

17. The electrospray ionization source of claim 13 wherein the programmable motor drives the nozzle holder at frequencies greater than 4 Hz.

* * * * *

UNITED STATES PATENT AND TRADEMARK OFFICE

CERTIFICATE OF CORRECTION

PATENT NO. : 6,995,362 B1
DATED : February 7, 2006
INVENTOR(S) : Michael J. Burke et al.

It is certified that error appears in the above-identified patent and that said Letters Patent is hereby corrected as shown below:

Column 1,
Line 11, add the following:

-- GOVERNMENT LICENSE RIGHTS

This invention was made with support under NIH Grant HG02159 from the National Institutes of Health. The United States government may have certain rights in the invention. --.

Signed and Sealed this

Twenty-third Day of May, 2006

JON W. DUDAS
*Director of the United States Patent and Trademark Office*